US005637123A

United States Patent [19]

Ishizaki et al.

[11] Patent Number: 5,637,123

[45] Date of Patent: Jun. 10, 1997

[54] POROUS METAL BOND GRINDER AND METHOD OF MANUFACTURING THE SAME

[75] Inventors: Kozo Ishizaki, 513-193, Nagaminecho, Nagaoka-shi, Niigata; Shin Yamamoto, Nagaoka; Atushi Takada, Ayauta-gun; Yoshihito Kondo, Takamatu, all of Japan

[73] Assignee: Kozo Ishizaki, Niigata, Japan

[21] Appl. No.: 387,593

[22] Filed: Feb. 13, 1995

[30] Foreign Application Priority Data

Feb. 19, 1994 [JP] Japan ..... 6-059738
Feb. 19, 1994 [JP] Japan ..... 6-059740

[51] Int. Cl.[6] ..... B24D 3/02

[52] U.S. Cl. ..... 51/296; 51/307; 51/309

[58] Field of Search ..... 51/296, 307, 309

[56] References Cited

U.S. PATENT DOCUMENTS

| | | | |
|---|---|---|---|
| 3,650,715 | 3/1972 | Brushek et al. | 51/309 |
| 3,820,966 | 6/1974 | Sejbal et al. . | |
| 3,841,852 | 10/1974 | Wilder et al. | 51/307 |
| 3,902,873 | 9/1975 | Hughes | 51/309 |
| 4,024,675 | 5/1977 | Naidich et al. | 51/296 |
| 4,077,808 | 3/1978 | Church et al. | 51/295 |
| 4,234,661 | 11/1980 | Lee et al. | 51/307 |
| 4,253,850 | 3/1981 | Rue et al. | 51/296 |
| 4,555,250 | 11/1985 | Horie et al. | 51/309 |
| 4,977,710 | 12/1990 | Une . | |
| 5,035,725 | 7/1991 | Halpert et al. | 51/296 |

FOREIGN PATENT DOCUMENTS 1555326 1/1969 France .

*Primary Examiner*—Deborah Jones
*Attorney, Agent, or Firm*—Koda and Androlia

[57] ABSTRACT

A porous iron system metal bond diamond grinder using diamond as grinding particles and iron system metal powder as binder so as to have a large number of pores in the binder. The grinding particles are chemically and physically combined with the iron system metal to be held. The occupancy rate of pores in the whole grinder is 5 to 60%. The iron system metal is selected from a group composed of mixtures of iron powder, carbon-coated iron powder, iron nitride powder, carbon and iron. Carbon of diamond constituting the grinding particles is reacted to the iron system metal in the surface. In the manufacturing method, grinding particles and binder are mixed and molded into a predetermined shape and the molded product is then heated and sintered at 900° to 1150° C. The occupancy rate of pores and/or the concentration gradient of diamond are adjusted. The porous iron system metal bond diamond grinder capable of performing grinding continuously for a long time without loading can be provided.

4 Claims, 4 Drawing Sheets

● POROUS CAST IRON BOND DIAMOND GRINDER CARBON AMOUNT 3.5% AND AVERAGE PARTICLE DIAMETER 20 μm OR LESS

□ COMMERCIAL VITRIFIED GRINDER

△ COMMERCIAL RESINOID GRINDER

○ COMMERCIAL NO-PORE CAST IRON BOND GRINDER

POROUS METAL BOND GRINDER AND METHOD OF MANUFACTURING THE SAME

BACKGROUND OF THE INVENTION

1. Field of the Invention

The present invention relates to a porous metal bond grinder or whetstone used to grind various materials and a method of manufacturing the grinder. More particularly, the porous grinder of the present invention has an increased occupancy rate of pores so that the grinding function by grinding particles is enhanced to improve the grinding quality thereof.

2. Prior Art

A grinder is used to grind various works. A grinder used for grinding is composed of grinding particles and binder and has innumerable pores formed therein. The grinding particles function as edges for cutting or grinding various works, and the binder functions as a support for combining the grinding particles with each other. Further, a large number of continuous pores function as chip pockets for discharging chips cut off by grinding particles.

Recently, various devices or apparatuses often use material such as ceramics, cemented carbide or hard metal or superspeed steel which is difficult to grind. Accordingly, the need for grinding a material of this type has increased more and more. As a grinder or a grinding wheel for grinding a material of this type, one using super grinding particles such as diamond grinding particles or boron nitride grinding particles of the cubic system is being gradually used.

As a grinder using such super grinding particles, there are various kinds of grinders such as a vitrified bond system, a resinoid bond system, a metal bond system, a silicate bond system and a rubber bond system in accordance with the kinds of the binder. These grinders have both merits and demerits, while the grinder of the metal bond system using metal and its alloy as the binder thereof is mainly used in view of its strength and long life.

The grinder of the metal bond system is manufactured by putting metal powder having grinding particles scattered uniformly into a mold together with a metal base and subjecting it to pressing and sintering (or hot pressing) processes. The binder of metal used in the metal bond grinder uses, for example, a Cu-Sn system, a Cu-Sn-Co system, a Cu-Sn-Fe-Co system, a Cu-Sn-Ni system or a Cu-Sn-Fe-Ni system or any of these systems to which phosphorus (P) is added.

The grinding particles of a conventional metal bond grinder has an extremely strong combination or binding strength as compared with the resinoid bond grinder and the vitrified bond grinder. Accordingly, the metal bond grinder can advantageously exert a sufficient retention force required to perform strong grinding by means of super grinding particles. However, the metal binder does not have sufficiently large pores to help discharge chips that are cut off by the grinding particles. Thus, "escape bores" in which chips enter are restricted to minute gaps between the metal bond grinder and a work or to minute gaps constituted by portions in the metal bond grinder in which grinding particles have fallen off. Further, in the metal bond grinder, the binding force of the grinding particles is extremely strong and accordingly when the grinding particles are worn, the worn particles have difficulty falling off from the binder. Hence, it is also difficult to form the "escape bores" that are formed by the grinding particles that have fallen off.

As described above, in the conventional metal bond grinder, the discharging of chips is deteriorated and loading occurs easily. Accordingly, the grinding resistance increases and the grinding quality deteriorates, so that the heat generated is increased. Further, the grinder has a tendency to unsuccessfully finish the surface of a work. Accordingly, it is very difficult to increase the contact area of the grinder and the work and perform grinding with higher efficiency.

In addition, the conventional metal bond grinder has a low sintering temperature and is hence apt to be softened at a low temperature. Accordingly, there is a defect in that plastic deformation occurs due to the heat generated upon grinding and the loading takes place in the surface of the grinder.

In order to eliminate the above defects, for example, Japanese Patent Application Laid-Open No. 59(1984)-182064 discloses a continuous porous metal bond grinder. However, this metal bond grinder does not utilize the powder sintering method. More particularly, in the manufacturing method of this metal bond grinder, an inorganic compound that is melted by solvent is sintered into a desired shape. Thereafter, gaps or spaces of the sintered body are filled with grinding particles and the body having spaces filled with grinding particles is heated. Then, melted metal or alloy is pressed into the spaces of the thus sintered body filled with the grinding particles and is then solidified. Thereafter, the inorganic compound is liquated out by a solvent.

Further, Japanese Patent Application Publication No. 54(1979)-31727 discloses a grinder that has many layers of metal coatings formed thereon and is sintered so as to be structured like a vitrified bond by hot press and has pores. In addition to this, various measures for preventing reduction in grinding quality have been proposed.

Furthermore, Japanese Patent Application Laid-Open No. 3(1991)-264263 discloses a grinder using cast iron for the purpose of preventing loading of the grinder. The grinder using the cast iron as a bond advantageously has great strength and high rigidity and is worn in the brittle fracture manner without the occurrence of plastic deformation, so that loading is less likely to occur. However, the bond of this grinder is too strong and accordingly the dressing property is deteriorated as compared with the bond of the copper system.

By forming a large number of pores within the grinder, grinding liquid can be impregnated into the pores to enhance the cooling characteristics of the grinder and a large number of chip pockets can be formed in the grinding surface to improve the discharging characteristics of chips. Further, the grinding resistance can be made small by the pores to improve the grinding quality. In other words, it can be expected that less heat is generated and the surface of a work is finished with high quality. However, when a large number of pores are formed in the conventional copper system metal bond grinder, the strength and the retention force of grinding particles thereof are naturally reduced, so that the sufficient grinding performance cannot be obtained.

Further, in the grinder using non-porous cast iron as the bond, iron powder is added to cast iron powder because of the inferiority of the sintering characteristics of the cast iron powder and then pressurized with the load of 8,000 kgf/cm$^2$ to 1,000 kgf/cm$^2$. By adding the iron powder, the original brittle fracture characteristic of the cast iron is lost and plastic deformation is apt to occur due to heat generated upon grinding in the same manner as the copper system bond, so that the characteristics of the cast iron cannot be drawn out sufficiently.

SUMMARY OF THE INVENTION

It is an object of the present invention to increase the occupancy rate of pores in the whole grinder.

It is a further object of the present invention to reduce wear of the grinder and improve the grinding quality thereof.

Generally, pores formed in the grinder serve to temporarily hold chips produced upon grinding and easily discharge the chips when the grinder is separated from a work. By forming the pores, the loading is suppressed and the grinding quality of the grinder is improved. The pores also serve to radiate a large quantity of grinding heat generated upon grinding. When the prevention of burning due to grinding is an objective, a grinder that has a large occupancy rate of pores is needed and a grinder having large-diameter pores formed intentionally is often used if necessary.

According to the present invention, a large number of pores are formed in a so-called matrix-type metal bond surrounding grinding particles in the metal bond grinder to improve the mechanical characteristics of the binder portion (metal bond) and/or the retention force of grinding particles. Further, the mechanical characteristics of the binder and/or the retention force of grinding particles are improved by the interstitial solid solution reaction of the binder if necessary.

More particularly, the porous metal bond grinder of the present invention comprises grinding particles constituted by super grinding particles and binder constituted by metal powder, and the super grinding particles are held by the binder portion constituting the porous structural phase formed by sintering powder.

DETAILED DESCRIPTION OF THE PREFERRED EMBODIMENTS

Figure 1:
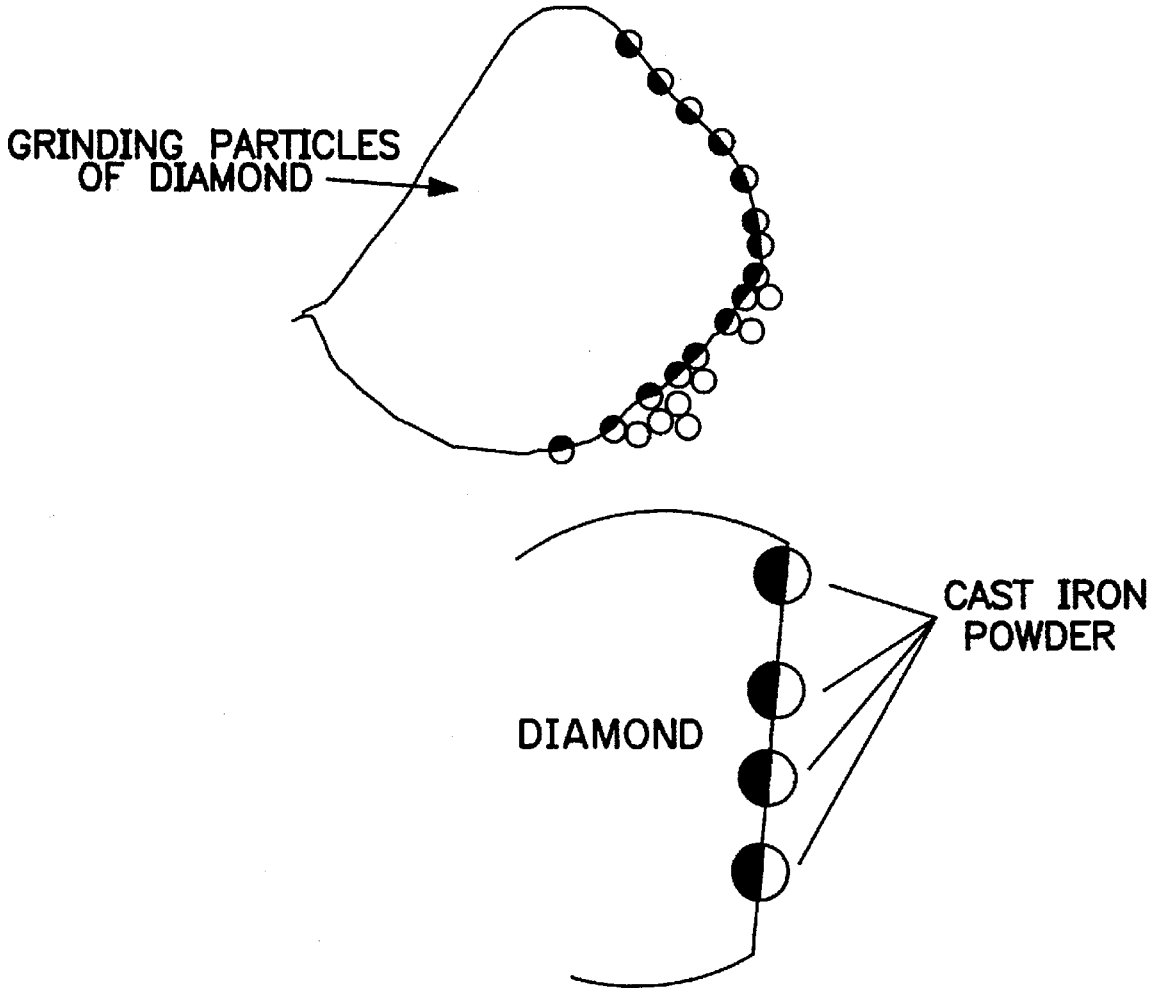
FIG. 1 schematically illustrates diamond grinding particles and cast iron powder of a porous cast iron bond diamond grinder according to the present invention which are reacted to be joined with each other.

In the present invention, super grinding particles such as diamond grinding particles or boron nitride grinding particles of the cubic system are used as grinding particles, and metal powder capable of effecting the interstitial solid solution reaction is used as a binder. Metal capable of effecting the interstitial solid solution reaction includes alloy powder particles capable of effecting the solid solution reaction to carbon, nitrogen and/or silicon.

The metal bond is characterized in that the force of retaining grinding particles is increased since the binding strength of the bond is extremely large. Pores that cause a reduction in the retention force of the grinding particles are not formed in the prior art metal bond. In the present invention, by forming pores in the metal bond, the binding strength of the metal bond can be controlled and the metal bond can be worn properly without resistance in the grinding process.

When the occupancy rate of pores in the bond is too small, the retention force of retaining grinding particles becomes too strong, so that grinding particles worn by the grinding operation do not fall off but remain, thus reducing the grinding force of the grinder. On the contrary, when the occupancy rate of pores in the bond is too large, the retention force of the retained grinding particles becomes too weak, so that grinding particles have a tendency to fall off from the binder metal. Consequently, wear of the whole grinder increases and the life of the grinder is shortened.

In the present invention, the mechanical characteristic of the binder portion and/or the retention force of the grinding particles is controlled by adjusting the occupancy rate of pores and/or the concentration gradient of an interstitial solid solution element. The occupancy rate of pores and/or the concentration gradient of the interstitial solid solution dement is adjusted by a diameter of particles constituting metal powder, a molding condition and/or a sintering condition of the grinder, and an amount of carbon, nitrogen and/or silicon of the binder.

Further, in the present invention, diamond is used as the grinding particles and is combined with the iron system metal chemically and physically, and the retention force of the grinding particles is controlled so that the grinding particles do not fall off until the particles are worn. The chemical combination means that the carbon component of diamond constituting the grinding particles reacts to the iron system metal.

The occupancy rate of pores of the vitrified bond grinder is largest and is about 50% at maximum except in a special case. Most of the ranges of the occupancy rate used actually are about 35 to 40%. If the occupancy rate of pores is increased to about 50%, the strength of the grinder is reduced considerably and there is a possibility that the grinder can be broken.

However, in order to sufficiently exhibit the performance of the super grinding particles capable of effecting strong grinding and utilize the expensive grinder effectively, it is preferable that the content rate of grinding particles is basically reduced and the metal bond having the strong retention force of grinding particles is used as the binder, and it is desirable that the occupancy rate of pores is increased.

Heretofore, cast iron in the grinder using the cast iron bond is characterized by its strong strength as well as the brittle fracture. Iron is mixed with carbon to form a solid solution to thereby form the brittle fracture. In the copper system metal bond, the surface of the grinder is covered by the bond component due to plastic deformation caused by wear, while the cast iron bond of the present invention can prevent loading as a result of brittle fracture. In order to utilize the merit that the loading does not occur often, it is necessary to overcome the defect that the strength is too strong by adjusting the strength.

In the present invention, the occupancy rate of pores in the whole grinder is adjusted to 5 to 60% and preferably 5 to 45%. In the porous metal bond grinder of the present invention, the occupancy rate of pores of the whole grinder corresponds to the occupancy rate of pores in the binder. The occupancy rate of pores is adjusted in accordance with the diameter of the particles constituting metal powder, the molding condition of the grinder and/or the sintering condition of the grinder.

The bond itself of the conventional cast iron bond diamond grinder has hardly any pores and it is necessary to obtain gaps or spaces by means of interposition of the grinding particles or to add pores giving agency. On the contrary, the present invention is characterized in that the metal bond itself contains a large number of pores.

Thus, when the occupancy rate of pores of the whole grinder of the present invention is smaller than 5%, the strength of the bond thereof is increased considerably and the wearing characteristic of the binding metal, that is, the brittle fracture cannot be exhibited sufficiently. Accordingly, the lower limit of the occupancy rate of pores is set to 5%. Further, when the occupancy rate of pores is too large, the strength of the grinder is reduced and the grinder would probably be destroyed. Accordingly, the occupancy rate of pores is set to 60% or less, preferably 45% or less.

In the present invention, grinding particles are held by the porous phase having a lower sintering density of particles of the binder. The occupancy rate of pores is adjusted by the diameter of particles constituting metal powder, the molding condition of the grinder and the sintering condition of the grinder. That is, in order to control the mechanical strength of the metal bond and the retention force of grinding particles, the diameter of particles constituting metal powder, the molding condition of the grinder and the sintering condition of the grinder are adjusted.

Further, in the present invention, in addition to adjustment of the occupancy rate of pores, the concentration gradient of the interstitial solid solution element can be adjusted to control the mechanical strength of the metal bond and the retention force of the grinding particles. Accordingly, the present invention involves the aspect that the grinding particles are porous and retained or held by the interstitial solid solution. The reaction of alloy powder capable of effecting the solid solution reaction to carbon, nitrogen and/or silicon is adjusted by the diameter of particles of carbon, nitrogen and/or silicon and alloy powder. This adjustment is made to control the mechanical strength of the metal bond and the retention force of grinding particles.

In the present invention, the porous structural phase formed by the sintering of powder is constituted by the interstitial solid solution reaction occurring in the binder. The concentration gradient of the interstitial solid solution element is controlled by adjusting the particle size of the metal powder capable of effecting a solid solution reaction to carbon, nitrogen and/or silicon and an amount of carbon, nitrogen and/or silicon. When the metal powder capable of effecting a solid solution reaction to carbon, nitrogen and/or silicon is, for example, an iron system metal powder, such a metal powder is one or two selected from a group composed of a mixture of iron, carbon, iron nitride powder, carbon-coated iron powder and cast iron powder.

When super grinding particles are mixed with binder powder, for example, cast iron powder, so as to be sintered and a sintering temperature is reached, the surface of the iron powder begins to melt and sintering begins. At this time, when an amount of carbon, nitrogen and/or silicon of iron does not reach the allowable range, it can be reacted (diffusion binding) with adjacent carbon. The concentration gradient occurs among the binder due to the movement of material by diffusion upon sintering. Accordingly, the interstitial solid solution reaction is also influenced by the sintering density. As described above, when diamond is used as the grinding particles, an interstitial solid solution reaction occurs in the surface of the binder and the grinding particles depending on certain conditions.

Generally, iron includes varieties of types such as pure iron containing no carbon, carbon steel containing a little carbon and cast iron containing carbon of 1.7% or more. In the present invention, the carbon component of diamond which is used as the grinding particles is reacted to iron so as to improve the binding strength; accordingly, iron system metal powder is represented by cast iron but is not limited thereto.

The binder of the present invention can use varieties of material from pure iron containing no carbon, carbon steel containing a little carbon to cast iron containing carbon of 1.7% or more. In the case of a mixed powder of iron and carbon, iron and diamond or iron and carbon can be reacted together in the sintering of the grinder of the present invention; accordingly, such a mixed powder can form an iron bond which exhibits the brittle fracture operation as cast iron depending on the reaction amount of carbon and iron.

With respect to the carbon concentration of iron system metal and the concentration gradient of diamond, iron can contain carbon of about 6 to 7%. That is, when an amount of carbon is, for example, 3%, iron can be further reacted to carbon of 3 to 4%. When diamond is mixed with iron powder to be sintered and a sintering temperature is reached, the surface of the iron powder begins to melt and the sintering is started. At this time, when the amount of carbon in iron does not reach the allowable range, the iron can be reacted (diffusion binding) to adjacent carbon.

When the sintering temperature is not reached, the carbon concentration gradient of diamond and iron powder is infinite. The concentration gradient occurs in diamond and iron due to the movement of material by diffusion upon sintering. Particularly, when the amount of carbon in iron is little, the concentration gradient is large and more carbon can be reacted to iron. When the reaction is advanced to excess, grinding particles are deteriorated and accordingly it is necessary to select the sintering condition so that the reaction is made in the surface.

The grinder of the present invention is now described by taking a porous cast iron bond diamond grinder using diamond as the super grinding particles and cast iron as the binder by way of example.

In the present invention, in order for the porous cast iron bond diamond grinder to have the same strength and retention force of grinding particles as those of the copper system metal bond grinder, the amount of carbon in cast iron powder and the diameter of particles constituting the cast iron powder are adjusted. The strength of the cast iron bond itself can be controlled by the carbon amount and the diameter of the cast iron powder. Further, the cast iron powder and diamond are reacted so as to be joined together as shown in FIG. 1. The joining strength can be also controlled by the carbon amount and the diameter of the cast iron powder.

A manufacturing method of the porous metal bond grinder of the present invention will now be described.

In the manufacturing method of the porous metal bond grinder of the present invention, super grinding particles are mixed with metal powder constituting the binder so as to be formed into a specific shape having a specific size and are then heated and sintered to thereby manufacture the porous metal bond grinder. At this time, the mechanical characteristics of the binder portion and the retention force of the grinding particles are controlled by the occupancy rate of pores. In addition to the occupancy rate of pores, the mechanical characteristics of the binder portion and the retention force of the grinding particles are controlled by utilizing the concentration gradient of the interstitial solid solution element.

Adjustment of the occupancy rate of pores and/or utilization of the concentration gradient of the interstitial solid solution element for control of the mechanical characteristics of the binder portion and the retention force of the grinding particles are made by changing the diameter of the particles constituting the metal powder as the binder, the molding condition of the grinder and the sintering condition of the grinder. The sintering temperature is within a temperature range of 0.8 Tm to Tm (where Tm is a melting point of the binder or a liquid phase producing temperature K). The sintering temperature varies depending on the kind of metal used, the particle size of its powder and the like and since grinding particles constituted by diamond are carbonized at about 1100° to 1200° C. even under vacuum and even in an insoluble atmosphere, a temperature lower than this temperature is adopted as the sintering temperature. Metal or alloy powder capable of effecting solid solution reaction to carbon, nitrogen and/or silicon is used as metal powder and the average particle size thereof is adjusted within a range of 0.01 to 500 μm. Further, an amount of carbon, nitrogen and/or silicon is adjusted accordingly.

A manufacturing method of the grinder of the present invention is now described by taking a manufacturing method of the porous cast iron bond diamond grinder by way of example.

The porous bond diamond grinder is manufactured by mixing diamond constituting the grinding particles with cast iron powder constituting the binder so as to form them into a predetermined shape having a predetermined size and then heating and sintering them at 900° to 1150° C.

A product molded into the form of the grinder is sintered by the sintering process. The sintering process is executed under a normal pressure and the sintering temperature is set to be higher than at least 900° C. The sintering temperature is determined in consideration of thermal deterioration in the case where diamond is used as the grinding particles and the fact that when the sintering temperature is high, sintering is advanced and a desired occupancy rate of pores of 5 to 60% in the whole grinder is not obtained. The desirable sintering temperature is within the range of 900° to 1150° C. Further, the sintering temperature is changed depending on the amount of carbon in cast iron and the particle size of its powder.

Control of the mechanical characteristics of the binder portion and the retention force of the grinding particles is made by adjusting the average particle size of the cast iron powder in a range of 0.01 to 500 μm and/or adjusting the amount of carbon in the cast iron powder to 4.5% or less, preferably 1 to 4.2%. The preferable average particle size of the cast iron is in a range of 5 to 80 μm and the maximum diameter thereof is preferably 500 μm or less.

Since the retention force for retaining the grinding particles is too strong when the occupancy rate of pores is too low, the grinding particles having worn cutting or grinding portions remain in the binder metal, and as a result the grinding capability of the grinder is deteriorated. Further, since the retention force for retaining the grinding particles is too weak when the occupancy rate of pores is too high, many grinding particles fall off from the binder metal, so that there is increased wear of the grinder and the life of the grinder is shortened.

By adjusting the average particle size and the carbon amount of the cast iron particles in the above range, diamond and cast iron can be diffused in a solid phase and the retention force of the grinding particles can be improved. Cast iron has a function for holding the grinding particles and accordingly it is desirable to have grinding particles having a small diameter so as to increase the contact area with grinding particles.

The porous cast iron diamond grinder of the present invention is manufactured by mixing cast iron powder with diamond grinding particles uniformly and putting them into a press device together with a metal base as usual to mold them with pressure in the same manner as that of the conventional grinder. The grinder thus sintered is joined to a cup-shaped grinder of a 6A2 type having a grinder diameter of 100 mm and is evaluated by the constant pressure grinding examination. The superiority of the porous cast iron bond grinder of the present invention has been confirmed as compared with the conventional no-pore type cast iron bond grinder, vitrified grinder and resinoid grinder.

In the manufacturing of the grinder, commercially available cast iron is used. Since the average diameter of particles constituting the cast iron powder is 100 μm or more and the distribution of the particle size is wide, it is difficult to sinter it even if the temperature is increased to the melting point of cast iron. Accordingly, by controlling the carbon amount and the particle diameter of the cast iron powder, the sintering characteristic, the mechanical strength and the occupancy rate of pores of the cast iron powder are adjusted.

In order to examine the influence of the carbon amount, commercially available cast iron powder of three kinds of 3.0%, 3.5% and 4.0% passed through a sieve of 38 μm or less is used. In order to examine the influence of the particle diameter, cast iron powder having a carbon amount of 3.5% are passed through a sieve so as to classify it into 20 μm or less, 20 to 32 μm, 38 to 45 μm and 45 to 75 μm.

Each cast iron powder particle and diamond grinding particle of the mesh size 100/200 are mixed with each other to have the convergence degree of 125 and are sintered under the atmosphere of argon at a temperature of 1120° C.

Further, the grinder manufactured above is subjected to the constant pressure grinding examination at the peripheral speed of the grinder of 100 m/min while using aluminum ceramics as the material to be grinded.

Table 1 (physical properties and grinding performances of the grinder manufactured by way of trial) shows the physical property values and the grinding results of the sintered porous bond diamond grinder.

TABLE 1

| | Influence of Carbon Amount | | | | Influence of Particle Diameter | | |
|---|---|---|---|---|---|---|---|
| Particle Diameter μm | <38 | <38 | <38 | <20 | 20–32 | 32–38 | 38–45 |
| Carbon amount % | 3.0 | 3.5 | 4.0 | 3.5 | 3.5 | 3.5 | 3.5 |
| Occupancy Rate of Pores % | 33 | 30 | 29 | 26 | 29 | 32 | 34 |
| Bending Strength MPa | 31 | 48 | 40 | 88 | 53 | 38 | 27 |
| Young's Modulus GPa | 29 | 36 | 34 | 59 | 36 | 28 | 25 |
| Grinding Energy GJ/m3 | 25 | 25 | 25 | 15 | 18 | 22 | 31 |
| Grinding Ratio | 100 | 80 | 40 | 100 | 50 | 50 | 5 |

As apparent from Table 1, the bending strength and the Young's modules are increased and the strength is increased as the particle diameter of the cast iron powder becomes smaller. When the carbon amount of cast iron powder is 3.5%, the bending strength and the Young's modules indicate the maximum values thereof. Further, with respect to grinding performance, the grinding energy (energy necessary for removing the material to be grinded) is reduced as the particle diameter of the cast iron powder becomes smaller and the material to be grinded can be removed with about half the energy. The grinding ratio also indicates the same result as the grinding energy.

Figure 2:
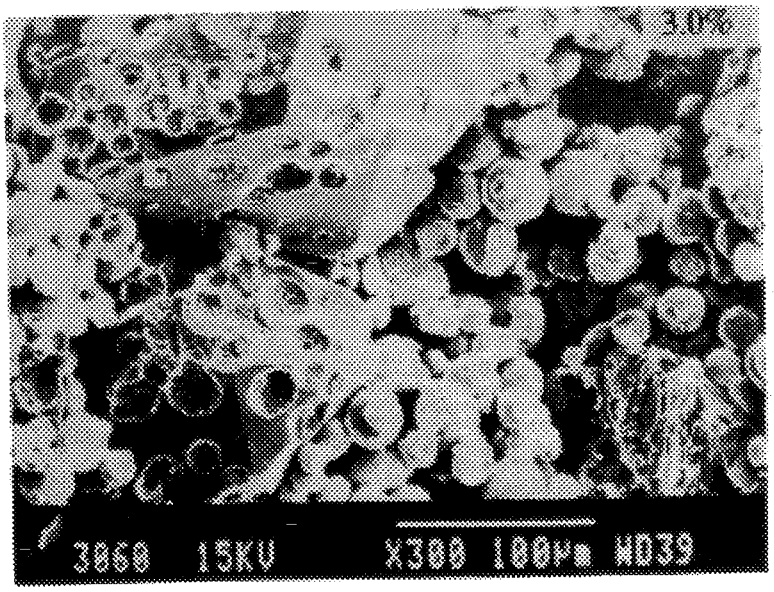
FIG. 2 is a microscopic photograph showing diamond grinding particles and cast iron bond joined with each other in the cases where an amount of carbon of cast iron powder is 3.5% and the diameter of particles thereof is 20 μm.

FIG. 2 shows a microscopic photograph when the carbon amount is 3.5% and the particle diameter of the cast iron powder is 20 μm. The joining of cast iron particles and of diamond and cast iron bond is made by a chemical reaction. Carbon in the surface of diamond is formed into a solid solution together with cast iron to enhance the joining strength. The inclination thereof is increased as the particle diameter becomes smaller; and since the contact points are increased, the bending strength and the Young's modules are increased. Thus, since the retention force of the diamond grinding particles is increased upon the grinding, grinding particles do not fall off; and since the material to be grinded is removed, the grinding energy is reduced and the grinding ratio is increased.

As described above, the physical properties and the grinding performances of the porous cast iron diamond grinder can be controlled in accordance with the particle diameter and the carbon amount of the cast iron powder.

Details of the present invention will now be described with reference to the embodiments. The present invention is not limited by these embodiments.

EMBODIMENT 1

Diamond grinding particles which have meshes of 120 and cast iron powder which has a carbon amount of 3.5% and the average particle diameter of 20 μm or less were used to be sintered under the atmosphere of argon gas at the temperature of 1120° C. to obtain the porous cast iron bond diamond grinder.

The obtained porous cast iron bond diamond grinder was compared with the commercially available vitrified grinder, resinoid grinder and no-pore cast iron bond grinder.

The shape of the respective grinders is cup-shaped as of the 6A2 type having a diameter of 100 mm and a convergence degree unified to 125. The constant pressure grinding examination was made at the peripheral speed of the grinder of 1100 m/rain using alumina as the material to be grinded.

Figure 3:
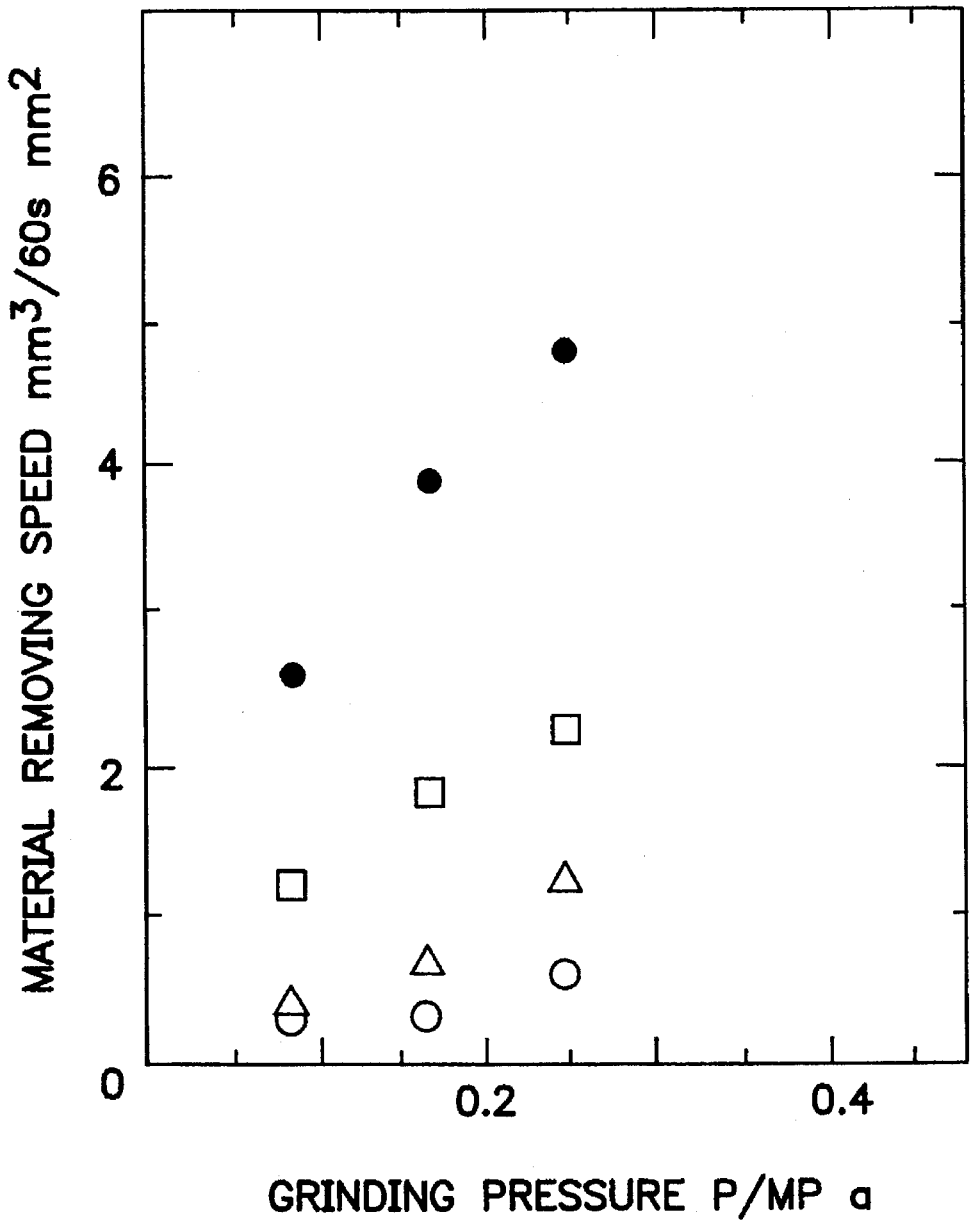
FIG. 3 is a diagram showing the relation of grinding pressure and a removing speed of the grinder according to an embodiment of the present invention.

The result thereof is shown in FIG. 3 (diagram showing the relation of the grinding pressure and the removal speed).

In any grinders, the removal speed is increased as the grinding pressure is increased. The porous cast iron bond of the present invention exhibited about double the grinding performance as compared with the commercially available vitrified grinder which is said to have an excellent grinding quality. Further, the grinding ratio of the cast iron bond of the present invention exhibited a performance double that of the other bond.

EMBODIMENT 2

The grinder manufactured in the Embodiment 1 was used to make the grinding examination of silicon nitride under the same condition as that of the Embodiment 1.

Figure 4:
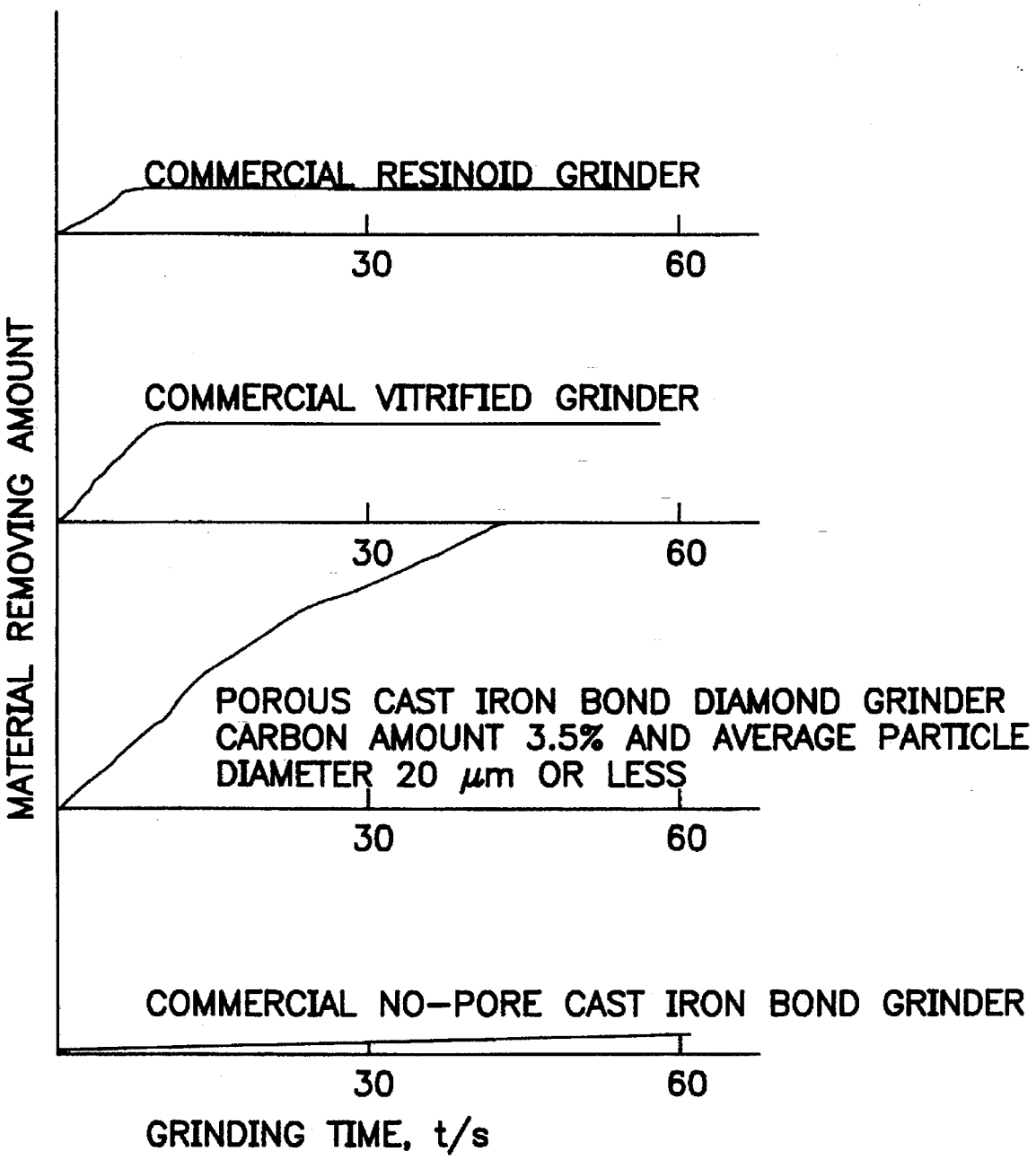
FIG. 4 is a diagram showing the relation of a grinding time and an amount of removal of the grinder according to the embodiment of the present invention.

The result thereof is shown in FIG. 4 (diagram showing the relation of the grinding time and the removal amount by grinding).

In the case of the commercially available vitrified bond grinder and the commercially available resinoid bond grinder, the removal amount by grinding was increased in proportion to the time in the first 30 seconds of grinding, but thereafter the grinder was loaded, so that the removal amount was not increased. In the case of the porous cast iron bond grinder of the present invention, the removal amount by grinding was increased in proportion to the time from just after starting of the grinding to the completion of the examination. Since the porous cast iron bond has an excellent crushing characteristic, the cutting edges of diamond are maintained and the grinding force is sustained.

As described above, according to the present invention, a porous metal bond grinder is provided having a desired strength and occupancy rate of pores. The porous metal bond grinder is capable of performing grinding continuously for a long time without loading. The grinder has an excellent grinding quality as compared with the vitrified bond grinder and has less wear than that of the resinoid bond grinder. The grinder of the present invention can be used in a general-purpose grinding machine sufficiently and has an excellent dressing characteristic. Accordingly, the dressing on the machine can be performed in the same manner as the vitrified bond and the resinoid bond and since the grinding ratio is large, the grinding cost can be reduced greatly.

We claim:

1. An abrasive article comprising:

a sintered mixture of abrasive particles and metal powders; and wherein:

said abrasive particles are super abrasive particles selected from the group consisting of diamond and boron nitride;

said abrasive particles and said metal powders are bonded by interstitial solid solution reaction during sintering;

said metal powders are a binder for said abrasive particles during sintering; and said abrasive article has a porosity of 5 to 60% by volume.

2. An abrasive article according to claim 1, wherein said abrasive particles comprise diamond and said metal powders comprise cast iron powders comprising iron powders and carbon, and wherein said diamond and metal powders are bonded by the interstitial solid solution reaction of iron powder and carbon.

3. An abrasive article according to claim 1, wherein said abrasive particles comprise cubic boron nitride and said metal powders comprise iron nitride powders and wherein said cubic boron nitride and said metal powders are bonded by the interstitial solid solution reaction of iron and nitrogen.

4. An abrasive article according to claim 2, wherein the carbon is present in said cast iron powder in a range of 1 to 4.2% by weight of said metal powders.

* * * * *